US010519749B2

(12) United States Patent
McChesney et al.

(10) Patent No.: US 10,519,749 B2
(45) Date of Patent: Dec. 31, 2019

(54) ADJUSTABLE STEAM INJECTION TOOL

(71) Applicant: Halliburton Energy Services, Inc., Houston, TX (US)

(72) Inventors: Ryan Wesley McChesney, Carrollton, TX (US); Austin Lee Wright, Dallas, TX (US)

(73) Assignee: Halliburton Energy Services, INC., Houston, TX (US)

( * ) Notice: Subject to any disclaimer, the term of this patent is extended or adjusted under 35 U.S.C. 154(b) by 509 days.

(21) Appl. No.: 14/911,668

(22) PCT Filed: Sep. 18, 2014

(86) PCT No.: PCT/US2014/056294
§ 371 (c)(1),
(2) Date: Feb. 11, 2016

(87) PCT Pub. No.: WO2016/043747
PCT Pub. Date: Mar. 24, 2016

(65) Prior Publication Data
US 2016/0281467 A1 Sep. 29, 2016

(51) Int. Cl.
*E21B 34/14* (2006.01)
*E21B 43/24* (2006.01)
(Continued)

(52) U.S. Cl.
CPC ..... *E21B 34/14* (2013.01); *E21B 43/12* (2013.01); *E21B 43/2406* (2013.01); *E21B 2034/007* (2013.01)

(58) Field of Classification Search
CPC .... E21B 2034/007; E21B 34/06; E21B 34/08; E21B 34/04; E21B 43/12; E21B 43/123; E21B 43/16; E21B 43/2406
See application file for complete search history.

(56) References Cited

U.S. PATENT DOCUMENTS 5,540,253 A 7/1996 Junier
6,655,409 B1 12/2003 Steenburgh et al.
(Continued)

FOREIGN PATENT DOCUMENTS

CA 2765812 7/2013

OTHER PUBLICATIONS

Halliburton Energy Services, Inc., "Intellegent Completions sSteam Valve", available online at http://www.halliburton.com/public/cps/contents/Books_and_Catalogs/web/CPSCatalog/03_Intelligent_Completions.pdf, at least as early as Sep. 12, 2014, 1 page.
(Continued)

*Primary Examiner* — Robert E Fuller
*Assistant Examiner* — Christopher J Sebesta
(74) *Attorney, Agent, or Firm* — Kilpatrick Townsend & Stockton LLP

(57) ABSTRACT

An adjustable fluid injection tool for use in a wellbore may be used to provide steam to a wellbore annulus. The tool may be adjusted immediately before being positioned in a well. Fluid may exit an inner space of the tool into an accumulation chamber, after which the fluid may exit the tool through one or more adjustable valves. An adjustable valve may be formed between a valve seat of a shroud and a valve plug of a plug sleeve. The plug sleeve may be positioned around a tubular of the tool and able to translate linearly with respect to the shroud by rotating the plug sleeve, thus adjusting the adjustable valve and controlling fluid flow out of the tool.

17 Claims, 5 Drawing Sheets

(51) Int. Cl.
*E21B 43/12* (2006.01)
*E21B 34/00* (2006.01)

(56) References Cited

U.S. PATENT DOCUMENTS 7,350,577 B2 4/2008 Howard et al.
7,631,694 B2 12/2009 Struyk et al.
2005/0072578 A1 4/2005 Steele et al.
2006/0048942 A1* 3/2006 Moen ..... E21B 43/12 166/306
2008/0169095 A1* 7/2008 Struyk ..... E21B 36/00 166/250.06
2008/0264628 A1* 10/2008 Coronado ..... E21B 34/08 166/227
2009/0014168 A1* 1/2009 Tips ..... E21B 33/14 166/73
2010/0084130 A1* 4/2010 Richards ..... E21B 21/103 166/250.08
2010/0252250 A1* 10/2010 Fripp ..... E21B 34/08 166/66
2011/0017469 A1 1/2011 Malone et al.
2011/0198097 A1* 8/2011 Moen ..... E21B 34/08 166/373
2012/0145398 A1 6/2012 Schultz et al.
2012/0298356 A1* 11/2012 Sladic ..... E21B 41/0078 166/263
2013/0000740 A1* 1/2013 Veit ..... E21B 34/102 137/12
2013/0186623 A1* 7/2013 Waterhouse ..... E21B 43/12 166/272.3
2016/0326843 A1* 11/2016 Harmat ..... E21B 41/0078

OTHER PUBLICATIONS

International Patent Application No. PCT/US2014/056294, International Search Report and Written Opinion dated Jun. 3, 2015, 13 pages.

* cited by examiner

ADJUSTABLE STEAM INJECTION TOOL

CROSS-REFERENCE TO RELATED APPLICATIONS

This is a U.S. national phase under 35 U.S.C. 371 of International Patent Application No. PCT/US2014/056294, titled "ADJUSTABLE STEAM INJECTION TOOL" and filed Sep. 18, 2014, which is incorporated herein by reference in its entirety.

TECHNICAL FIELD

The present disclosure relates to oilfield operations generally and more specifically to steam assisted gravity drainage.

BACKGROUND

In oilfield operations, it may often be useful to control the passage of fluid between the inside of a wellbore tubular and an annulus between the tubular and the wellbore or casing. During steam assisted gravity drainage (SAGD) procedures, high-pressure, high-temperature steam may be injected into an upper wellbore to heat the surrounding formation, reducing the viscosity of heavy oil and bitumen in the formation, allowing the oil and bitumen to drain into a lower wellbore for production.

When a SAGD wellbore is prepared, multiple steam release nodes may be positioned along the length of the generally horizontal upper wellbore. In order to maximize the efficiency of the SAGD process, it may be desirable to adjust the amount of steam that is to be released at each node. Current SAGD nodes must be custom made to order after receipt of specifications for the particular SAGD wellbore. Custom made SAGD nodes may take a long time to prepare and ship and have extremely limited potential for re-use. Custom made SAGD nodes may be non-adjustable after manufacture or onsite. Changes in the SAGD wellbore specifications requiring more or less steam release from a particular node may occur after SAGD nodes have been ordered.

BRIEF DESCRIPTION OF THE DRAWINGS

The specification makes reference to the following appended figures, in which use of like reference numerals in different figures is intended to illustrate like or analogous components

DETAILED DESCRIPTION

Figure 1:
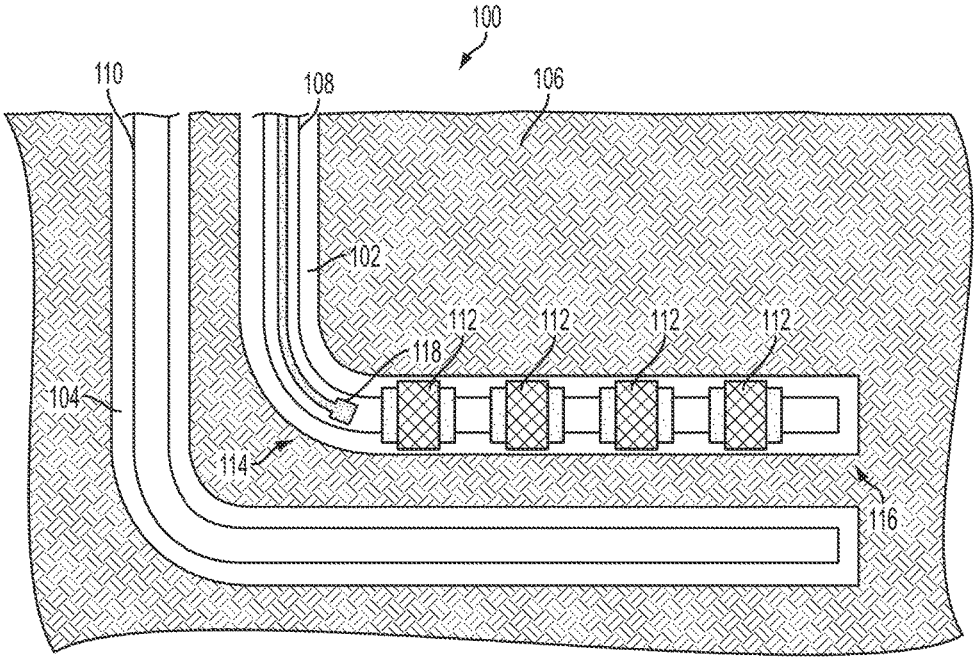
FIG. 1 is a schematic diagram of a wellbore servicing system that includes a series of fluid injection tools according to one embodiment.

Certain aspects and features of the present disclosure relate to an adjustable fluid injection tool for use in a wellbore. In some embodiments, the tool may be adjusted immediately before being positioned in a well. The fluid injection tool may be used to provide steam to a wellbore annulus. Fluid may exit an inner diameter of the tool into an accumulation chamber, after which the fluid may exit the tool through one or more adjustable valves. An adjustable valve may be formed between a valve seat of a shroud and a valve plug of a plug sleeve, or plug. The shroud may be coupled to a center nipple of the tool, while the plug sleeve is positioned around a tubular of the tool and able to translate linearly with respect to the shroud. As the plug sleeve translates, the gap between the valve plug and plug sleeve may be adjusted to control fluid flow out of the tool. A sliding side door may be actuated, such as by a shifting tool inserted within the inner diameter of the fluid injection tool, to enable or disable steam output from the fluid injection tool.

The accumulation chamber may condition the fluid upon exiting orifices in the injection housing (e.g., orifices in the center nipple). The accumulation may condition the fluid by lowering the velocity of the fluid before the fluid exits the injection tool.

The fluid injection tool may evenly distribute steam into a wellbore along a horizontal completion. Steam may be pumped into the fluid injection tool from the surface and may exit the fluid injection tool and travel axially in both directions of the completion along the annulus formed between the pipe (e.g., the fluid injection tool) and the casing or wellbore. Steam may locally heat bitumen hydrocarbon and other features of the surrounding formation to increase the temperature and lower viscosity of any hydrocarbons in the formation, allowing the hydrocarbons to flow into a lower completion and be produced to the surface.

Fluid may enter the internal diameter ("ID") of the fluid injection tool through the injection housing. The injection housing may be a single tubular or may be one or more tubulars coupled together. In an embodiment, the injection housing includes a top sub (e.g., upper tubular) coupled to a bottom sub (e.g., lower tubular) by a center nipple. Fluid may pass through orifices in the injection housing and into an accumulation chamber formed between a shroud and the injection housing. The shroud may be coupled to the outer diameter ("OD") of the injection housing. The fluid in the accumulation chamber may exit the tool through an adjustable valve. The amount of fluid passing through the accumulation chamber (E.g., amount of fluid, such as steam, being dispensed into the surrounding wellbore annulus) may be controlled by controlling the adjustable valve. If desired, the fluid injection tool may be used in situations where fluid flow in the opposite direction (e.g., from the wellbore annulus into the ID of the fluid injection tool) may be controlled.

In an embodiment, the adjustable valve is controlled by adjusting a gap between a valve seat and a valve plug. The valve seat may be located on the shroud and the valve plug may be located on a plug sleeve surrounding the injection housing. The adjustable valve may defined by the annulus between the valve seat and the valve plug. Fluid flow is controlled by the amount of pressure drop induced in the fluid due to its velocity, therefore the smaller the gap, the less fluid flow is allowed to exit the tool.

The plug sleeve may be movable with respect to the shroud. The plug sleeve may include internal threads engageable with external threads of the injection housing. The valve plug of the plug sleeve may be axially adjusted by rotating the plug sleeve about the injection housing. As the valve plug is axially adjusted, the gap between the valve plug and the valve seat increases or decreases, thus controlling the adjustable valve. The plug sleeve may be secured by a suitable securing element, such as a set screw, when the plug sleeve as reached the desired position.

The shroud may be coupled to the injection housing adjacent one end of the shroud. The opposite end of the shroud may be supported by a set of centralizing fins. The centralizing fins may centralize the shroud about the plug sleeve, ensuring the valve seat is centralized with respect to the valve plug. In some embodiments, the shroud is secured to an anchor point of the central nipple. In other embodiment, the shroud may be secured to an anchor point of a single tubular, for example when the injection housing comprises only a single tubular.

In some embodiments, the tool includes a sliding side door. With the sliding side door in an open position, fluid may pass from the ID of the tool to the accumulation chamber. With the sliding side door in a closed position, the sliding side door blocks fluid communication between the ID of the fluid injection tool and the accumulation chamber, thus blocking fluid communication with the wellbore annulus. Any steam passing into a fluid injection tool with a closed sliding side door will continue the injection housing, potentially to another fluid injection tool located further downwell. Seals (e.g., gaskets, seal stacks, or other suitable seals) in the injection housing interact with the sliding side door to block all or substantially all (e.g., most) steam from exiting the closed fluid injection tool.

In some embodiments, the valve seat may be axially translatable with respect to the valve plug. In such embodiments, the valve plug may be part of or be coupled to the injection housing. In such embodiments, the shroud may be movable coupled to the injection housing (e.g., via corresponding threads).

Adjustable fluid injection tools may be manufactured in large quantities and delivered to end users as identical units. Depending on the desired fluid flow characteristics, an end user may customize each of the adjustable fluid injection tools as desired at the rig site. A user may determine the desired about of fluid flow exiting the tool, may remove the securing element, may rotate the plug sleeve to the desired position, may replace the securing element, and may position the tool in the wellbore.

Increased standardization of the fluid injection tool may reduce engineering and production costs and may decrease lead times before a SAGD operation may begin producing valuable hydrocarbons.

The adjustable fluid injection tool described herein may be implemented with relatively few parts and relatively few parts that are susceptible to rapid erosion. The tool disclosed herein utilizes all of the available flow control surface area regardless of the flow rate, which may improve tool life and balance flow around the entire casing annulus or wellbore annulus.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

As used herein, the term "coupled" includes coupling via a separate object and also includes direct coupling. The term "coupled" also encompasses two or more components that are integral or continuous with one another by virtue of each of the components being formed from the same piece of material. Also, the term "coupled" may include chemical, mechanical, thermal, or electrical coupling.

FIG. 1 is a schematic diagram of a wellbore servicing system 100 that includes a series of fluid injection tools 112 according to one embodiment. The wellbore servicing system 100 also includes a first wellbore 102 and a second wellbore 104 penetrating a subterranean formation 106 for the purpose of recovering hydrocarbons, storing hydrocarbons, disposing of carbon dioxide, or the like. The wellbores 102, 104 may be drilled into the subterranean formation 106 using any suitable drilling technique. The wellbores 102, 104 may be vertical, deviated, horizontal, or curved over at least some portions of the wellbores 102, 104. The wellbores 102, 104 may be cased, open hole, contain tubing, and may include a hole in the ground having a variety of shapes or geometries.

A first workstring 108 may be supported in the first wellbore 102 and a second workstring 110 may be supported in the second wellbore 104. One or more service rigs, such as a drilling rig, completion rig, workover rig, or other mast structures or combinations thereof may support the workstrings 108, 110 in the wellbores 102, 104 respectively, but in other examples, different structures may support the workstrings 108, 110. For example, an injector head of a coiled tubing rigup may support one of the workstrings 108, 110. In some aspects, a service rig may include a derrick with a rig floor through which one of the workstrings 108, 110 extends downward from the service rig into one of the wellbores 102, 104. The servicing rig may be supported by piers extending downwards to a seabed in some implementations. Alternatively, the service rig may be supported by columns sitting on hulls or pontoons (or both) that are ballasted below the water surface, which may be referred to as a semi-submersible platform or rig. In an off-shore location, a casing may extend from the service rig to exclude sea water and contain drilling fluid returns. Other mechanical mechanisms that are not shown may control the run-in and withdrawal of the workstrings 108, 110 in the wellbores 102, 104. Examples of these other mechanical mechanisms include a draw works coupled to a hoisting apparatus, a slickline unit or a wireline unit including a winching apparatus, another servicing vehicle, and a coiled tubing unit.

The first workstring 108 in the first wellbore 102 may include one or more fluid injection tools 112. The first wellbore 102 may have a heel 114 and a toe 116. In some embodiments, a plurality of fluid injection tools 112 may be positioned at various locations along the first wellbore 102, between the heel 114 and the toe 116. During SAGD procedures, pressurized steam may be carried down the first workstring 108 and may be released into the first wellbore 102 by the fluid injection tools 112.

As the steam heats the subterranean formation 106, hydrocarbon deposits may increase in temperature and decrease in viscosity, allowing the hydrocarbon deposits to flow into the second wellbore 104, where they are collected by the second workstring 110 for production.

In some circumstances, steam may build up in large quantities around the heel 114 and toe 116 of the first wellbore 102. The uneven distribution of steam in the first wellbore 102 results in inefficient heating of hydrocarbon deposits, reducing the efficiency of hydrocarbon production.

More desirable steam dispersion may be achieved by throttling how much steam exits the first workstring 108 at different locations along the first wellbore 102. Control of steam release may be accomplished by adjusting adjustable valves in the fluid injection tools 112, as described in further detail below.

In some circumstances, it may be determined that it is no longer necessary to inject steam into certain locations within the first wellbore 102, for example because the portion of the subterranean formation 106 adjacent that location is saturated with water. In some embodiments, a fluid injection tool 112 may be closed by insertion of a shifting tool 118 into the first workstring 108. The shifting tool 118 may be any tool capable of shifting the fluid injection tool 112 from an open position to a closed position, as described in further detail herein. In some embodiments, the same or a different shifting tool 118 may be used to adjust a fluid injection tool 112 from a closed position to an open position.

Figure 2:
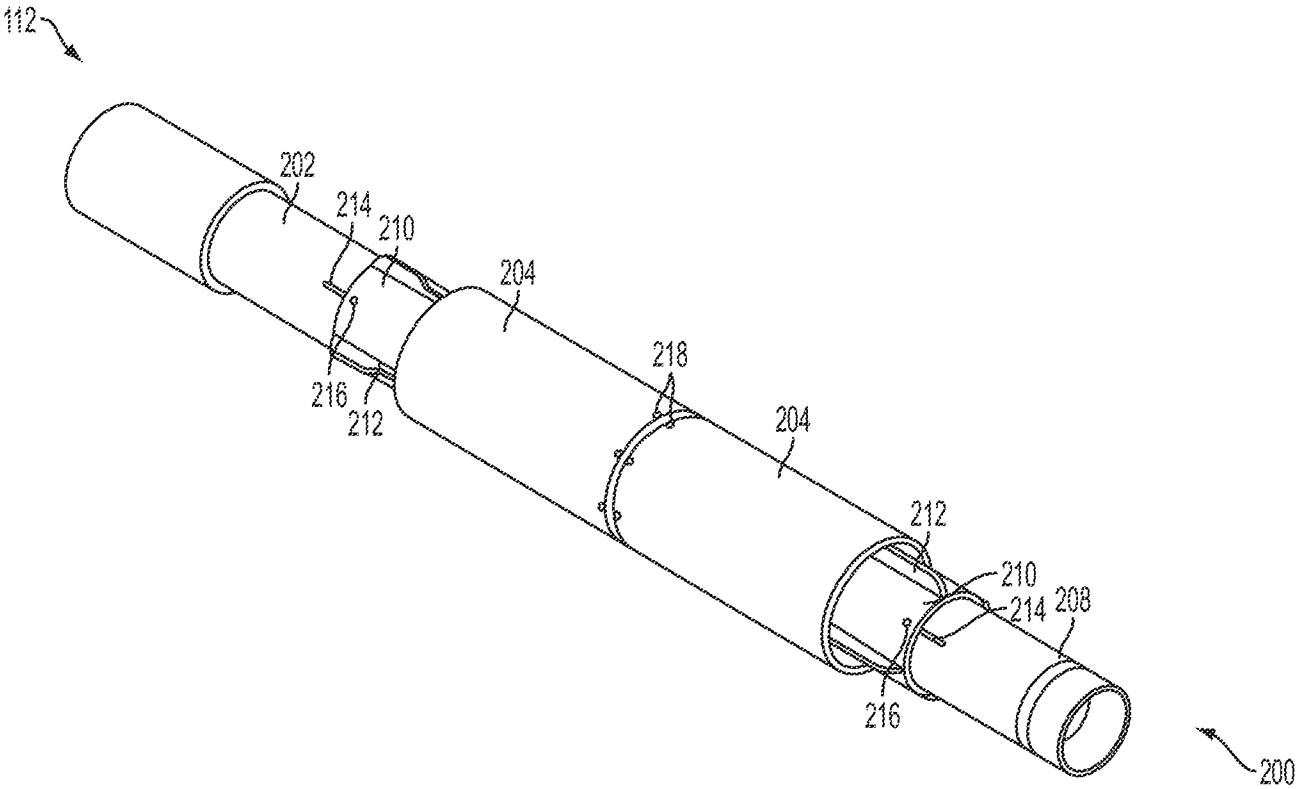
FIG. 2 is an axonometric view of a fluid injection tool according to one embodiment.

FIG. 2 is an axonometric view of a fluid injection tool 112 according to one embodiment. The fluid injection tool 112 comprises an injection housing 200 surrounded by a shroud 204. The injection housing 200 is made of an upper tubular 202 and a lower tubular 208 connected by a central nipple, as described in further detail below. In alternate embodiments, the injection housing 200 may be a single tubular.

The fluid injection tool 112 includes one or more shrouds 204. Each shroud 204 is coupled to the injection housing 200 by attachment elements 218. Attachment elements 218 may be bolts, welds, or any other suitable element for attaching the shroud 204 to the injection housing 200. The shroud 204 may be coupled to the injection housing 200 at one end, while being supported by fins 212 at the opposite end. The fins 212 may support and centralize the shroud 204 around a plug sleeve 210.

The plug sleeve 210 is linearly translatable with respect to the shroud 204. In one embodiment, the inner diameter of the plug sleeve 210 is threaded to cooperate with external threads of the injection housing 200. By rotating the plug sleeve 210 about the injection housing 200, the cooperating threads cause the plug sleeve 210 to translate linearly with respect to the injection housing 200. The plug sleeve 210 may be locked in place with a securing element 216. The securing element may be any suitable securing element 216, such as a clip or a set screw. In one embodiment, the securing element 216 is a set screw that may be screwed into the plug sleeve 210 and into a securing slot 214. In some embodiments four securing slots 214 are located around the circumference of the injection housing 200, but other number of securing slots 214 may be used.

Figure 3:
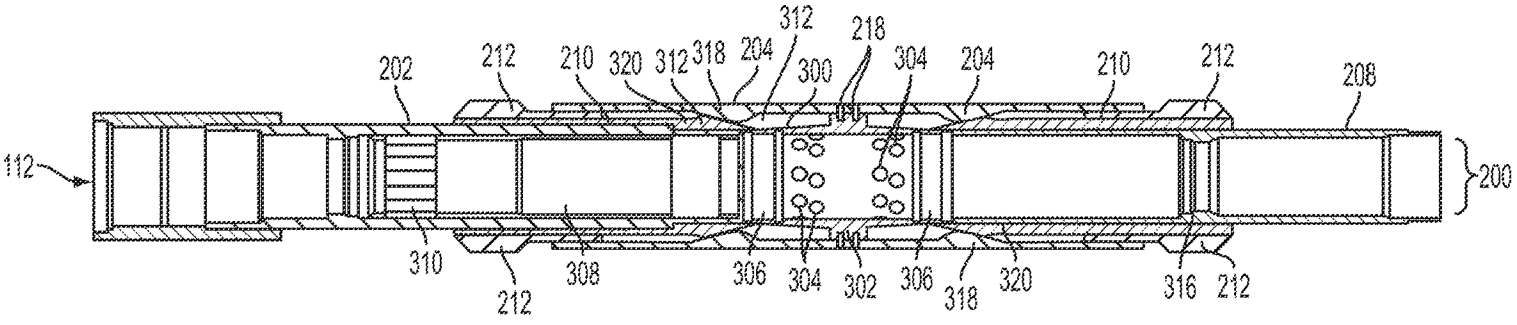
FIG. 3 is a cross-sectional view of the fluid injection tool of FIG. 2 with a sliding side door in an open position according to one embodiment.

FIG. 3 is a cross-sectional view of the fluid injection tool 112 of FIG. 2 with a sliding side door 308 in an open position according to one embodiment. The fluid injection tool 112 includes an injection housing 200. In one embodiment, the injection housing 200 includes an upper tubular 202 and a lower tubular 208 connected by a center nipple 300. In alternate embodiments, the injection housing 200 may include more or fewer tubulars. The upper tubular 202 and lower tubular 208 may each be connected to the center nipple 300 in any suitable way, including by a threaded connection with seals.

The center nipple 300 includes orifices 304 enabling fluid flow between the inner diameter of the injection housing 200 and an accumulation chamber 312. A sliding side door 308 is slidable between an open position and a closed position. In an open position, the sliding side door 308 does not block fluid flow through orifices 304. Fluid is free to flow through the orifice 304 and into the accumulation chamber 312. Fluid may also continue to flow through the injection housing 200 and on to a subsequent tubular, such as a subsequent fluid injection tool. The sliding side door 308 includes a collet 310 that retains the sliding side door 308 in either the open or closed position. Seal stacks in the injection housing 200 may help prevent fluid from flowing through the orifices 304 when the sliding side door 308 is in a closed position.

Fluid that passes out of the injection housing 200, through orifices 304, may enter accumulation chamber 312. Accumulation chamber 312 is bounded in part by the injection housing 200 and a shroud 204. The accumulation chamber 312 may be an annular space between the outer diameter of the injection housing 200 and the inner diameter of the shroud 204. The shroud 204 may be mounted to an anchoring point 302 of the center nipple 300. In alternate embodiments, the anchoring point 302 is separately coupled to the injection housing 200, rather than formed of the injection housing 200 (e.g., an anchoring point 302 welded or clamped to a single tubular injection housing 200). In some embodiments, multiple shrouds 204 may be mounted to the same anchoring point 302 in different directions. As seen in FIG. 3, two shrouds 204 are mounted to anchoring point 302 in opposing directions by attachment elements 218. Attachment elements 218 may include bolts, screws, welds, or any other suitable anchoring device. Seals may be used to ensure a fluid-tight seal between the shroud and the anchoring point 302.

The accumulation chamber 312 is fluidly coupled to an adjustable valve 330 that may be adjusted to control the fluid flow through the accumulation chamber 312. In one embodiment, fluid, such as steam, flows in a path from the inner diameter of the injection housing 200, through orifices 304, through the accumulation chamber 312, and out of the adjustable valve 330. Steam exiting the adjustable valve 330 can pass into a second chamber 332 defined by the plug sleeve 210 and the shroud 204. The steam can pass through the second chamber 332, past the centralizing fins 212 and out into the annulus formed between the injection tool 112 and the surrounding wellbore. Steam can additionally flow along the length of the wellbore towards or away from the surface. Some embodiments of the injection tool 112 allow steam to exit towards the surface, towards the toe 116 of the wellbore, or in both directions. In alternate embodiments, the adjustable valve 330 may be placed elsewhere. In alternate embodiments, the fluid may flow in the opposite direction (e.g., from the wellbore into the inner diameter of the injection housing 200).

The adjustable valve 330 may be comprised of a valve seat 318 and a valve plug 320. In an embodiment, the valve seat 318 is positioned on the shroud 204 and the valve plug 320 is positioned on the plug sleeve 210. In alternate embodiments, the valve plug 320 and valve seat 318 may be positioned elsewhere. The valve plug 320 may move laterally with respect to the valve seat 318 between a fully closed position and a fully open position. In a fully closed position, the valve plug 320 may abut the valve seat 318 and block all or substantially all fluid flow through (e.g., out of) the accumulation chamber 312. In various positions between the fully closed position and the fully open position, the valve plug 320 may be positioned to control the fluid flow through the accumulation chamber 312, thus controlling fluid flow out of the fluid injection tool 112.

The position of the valve plug 320 may be controlled by laterally translating the plug sleeve 210. As described above, the plug sleeve 210 may be laterally translated by rotating the plug sleeve 210 about the injection housing 200 due to the cooperating threads of the plug sleeve 210 and injection housing 200. When the injection housing includes an upper tubular 202, a lower tubular 208, and a center nipple 300, external threads that cooperate with one or more plug sleeves 210 may be located on one or more of the upper tubular 202, lower tubular 208, and center nipple 300. The valve plug 320 may be translated in other suitable ways.

The plug sleeve 210 may include fins 212 that centralize the shroud 204 about the plug sleeve 210. The fins 212 may help keep the shroud 204 secure and may maintain the valve seat 318 aligned with the valve plug 320. Fins 212 may also keep the fluid injection tool 112 centralized within the wellbore 102, such as to help keep the exiting fluid flow more centralized in the wellbore 102 instead of directly along one of the wellbore walls.

As seen in FIG. 3, a single fluid injection tool 112 may include multiple shrouds 204, multiple plug sleeves 210, allowing for more control of fluid injection. In alternate embodiments, a fluid injection tool 112 may have a single shroud and a single plug sleeve 210.

At a rig site, to configure the fluid injection tool 112 for a desired output, a user may remove or loosen the securing element 216, rotate the plug sleeve the desired number of times, and then replace or tighten the securing element. This may be repeated for each plug sleeve 210 on a fluid injection tool 112.

Figure 4:
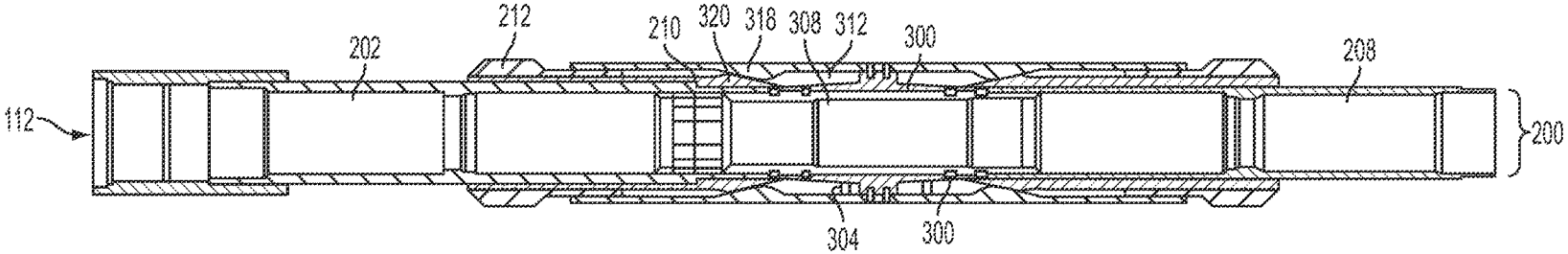
FIG. 4 is a cross-sectional view of the fluid injection tool of FIG. 2 with a sliding side door in a closed position according to one embodiment.

FIG. 4 is a cross-sectional view of the fluid injection tool 112 of FIG. 2 with a sliding side door 308 in a closed position according to one embodiment. The sliding side door 308 may be held in the closed position by contours in the injection housing 200, such as contours in the upper tubular 202, the center nipple 300, or the lower tubular 208. The sliding side door 308 blocks fluid flow through orifices 304 when in a closed position. Fluid is thus unable to flow through the accumulation chamber 312 and out of the adjustable valve 330 (e.g., past the valve seat 318 and valve plug 320, regardless of the position of the plug sleeve 210). All fluid flowing into the fluid injection tool 112 is thus directed through the injection housing 200 and out to another tubular, such as another fluid injection tool further down the wellbore.

Figure 5:
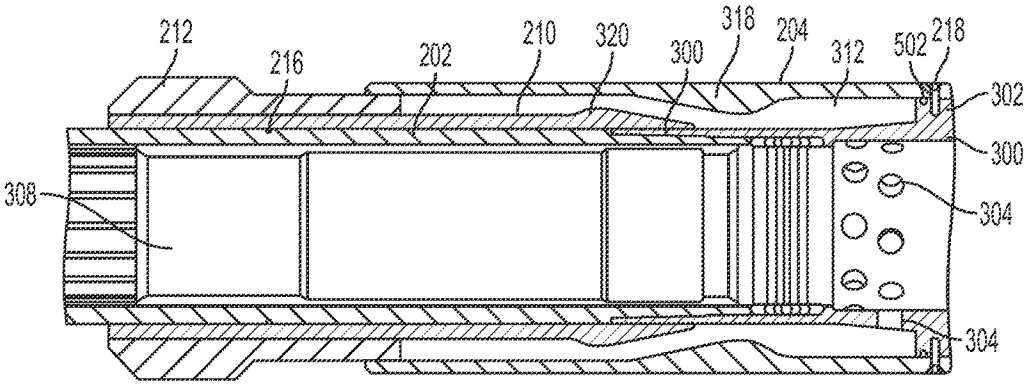
FIG. 5 is a cross-sectional view of a portion of the fluid injection tool of FIG. 2 with an adjustable valve in a nearly closed position according to one embodiment.

FIG. 5 is a cross-sectional view of a portion of the fluid injection tool 112 of FIG. 2 with an adjustable valve 330 in a nearly closed position according to one embodiment. The sliding side door 308 is shown open, allowing fluid to flow from the inner diameter of the upper tubular 202, through orifices 304, and into the accumulation chamber 312. Because the valve plug 320 of the plug sleeve 210 is positioned very near to the valve seat 318 of the shroud 204, little fluid is able to flow from the accumulation chamber 312, past the adjustable valve 330, and out to the exterior of the fluid injection tool 112 (e.g., to the wellbore annulus).

The shroud 204 is shown attached to the anchoring point 302 with an attachment element 218 and a seal 502. The shroud 204 is shown supported by fin 212. The plug sleeve 210 is shown secured to the upper tubular 202 by securing element 216 (e.g., a set screw). More than one securing element 216 may be used.

Figure 6:
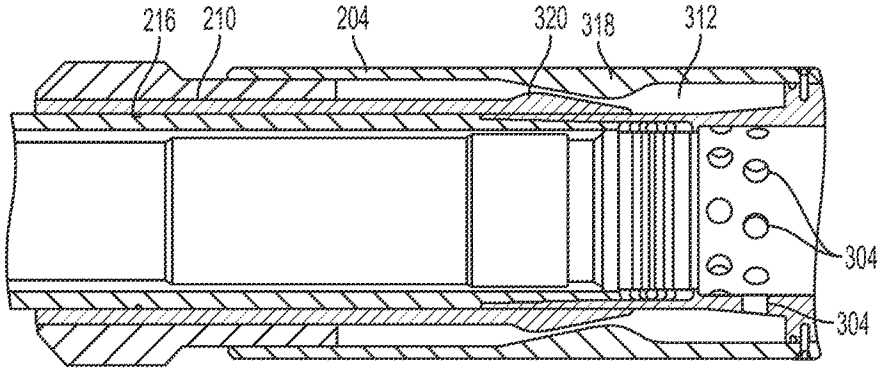
FIG. 6 is a cross-sectional view of a portion of the fluid injection tool of FIG. 2 with an adjustable valve in an open position according to one embodiment.

FIG. 6 is a cross-sectional view of a portion of the fluid injection tool 112 of FIG. 2 with an adjustable valve 330 in an open position according to one embodiment. In an open position, the valve plug 320 of the plug sleeve 210 is positioned a distance from the valve seat 318 of the shroud 204. Because the gap between the valve plug 320 and the plug sleeve 210 is large enough, fluid is able to flow through the accumulation chamber 312 and out to the exterior of the fluid injection tool 112.

The shroud 204 is shown attached to the anchoring point 302 with an attachment element 218 and a seal 502. The shroud 204 is shown supported by fin 212. The plug sleeve 210 is shown secured to the upper tubular 202 by securing element 216 (e.g., a set screw). More than one securing element 216 may be used.

In order to adjust the adjustable valve 330 to the nearly closed position (e.g. FIG. 5) from the open position (e.g., FIG. 6), one may remove the securing element 216, rotate the plug sleeve 210 the desired number of times, and the replace the securing element 216.

Figure 7:
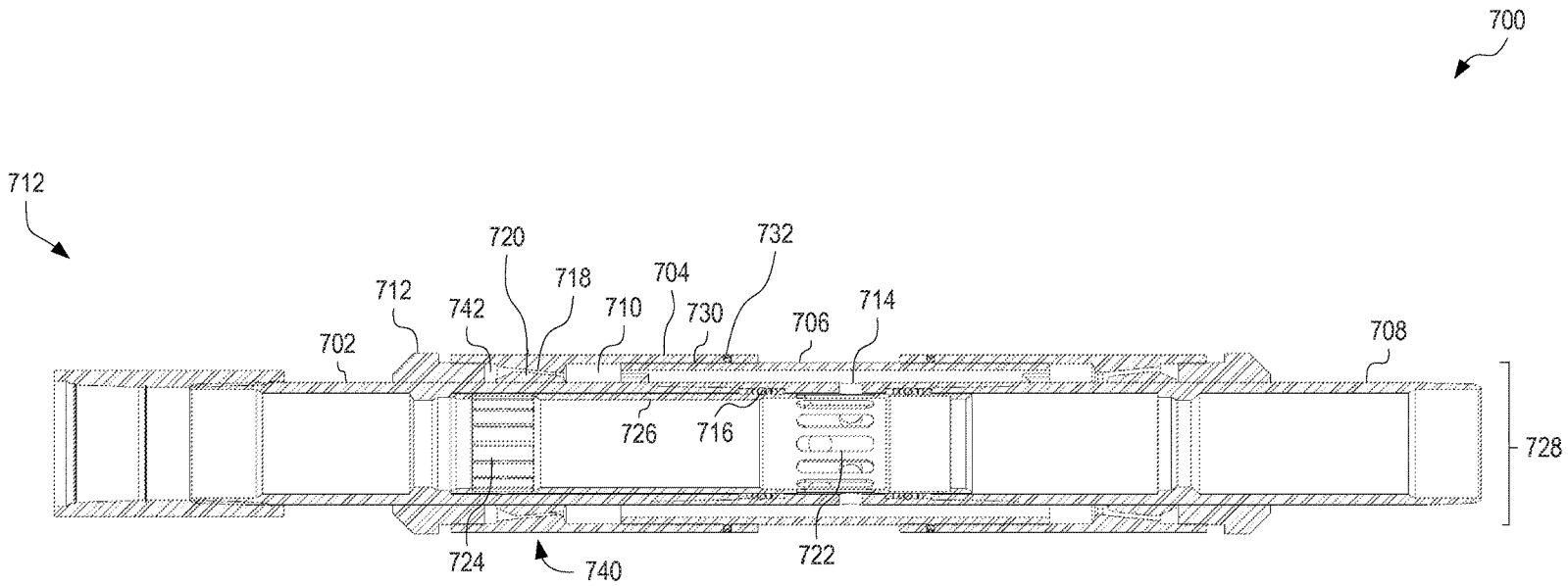
FIG. 7 is a cross-sectional view of a fluid injection tool according to one embodiment.

FIG. 7 is a cross-sectional view of a fluid injection tool 700 according to one embodiment. The fluid injection tool 700 includes an injection housing 728. In one embodiment, the injection housing 728 includes an upper tubular 702 and a lower tubular 708 connected by a center nipple 706. In alternate embodiments, the injection housing 728 may include more or fewer tubulars. The upper tubular 702 and lower tubular 708 may each be connected to the center nipple 706 in any suitable way, including by a threaded connection with seals.

The center nipple 706 includes orifices 714 enabling fluid flow between the inner diameter of the injection housing 728 and an accumulation chamber 710. A sliding side door 726 is slidable between an open position (as seen in FIG. 7) and a closed position. In an open position, the sliding side door 726 does not block fluid flow through orifices 714. In some embodiments, the sliding side door 726 includes openings 722 that align with the orifices 714 when the sliding side door 726 is in an open position. Fluid is free to flow through the orifices 714 and into the accumulation chamber 710. Fluid may also continue to flow through the injection housing 728 and on to a subsequent tubular, such as a subsequent fluid injection tool. The sliding side door 726 includes a collet 724 that retains the sliding side door 726 in either the open or closed position. Seal stacks 716 in the injection housing 728 may help prevent fluid from flowing through the orifices 714 when the sliding side door 726 is in a closed position. In embodiments where the sliding side door 726 includes openings 722, the openings 722 may be located on the opposite side of a seal stack 716 from the orifices 714 when the sliding side door 726 is in a closed position.

Fluid that passes out of the injection housing 728, through orifices 714, may enter accumulation chamber 710. Accumulation chamber 710 is bounded in part by the injection housing 728 and a shroud 704. The accumulation chamber 710 may include an annulus of the center nipple 706, as well as the annular space between the center nipple 706, the shroud 704, and a tubular of the injection housing 728 (e.g., the upper tubular 702).

The shroud 704 may be attached to the center nipple 706 by threading 730. Threading 730 may allow the shroud 704 to displace axially with respect to the center nipple 706 by rotating the shroud 704 about the center nipple 706. The shroud 704 may be secured in place by a securing element 732 (e.g., a set screw).

The accumulation chamber 710 is fluidly coupled to an adjustable valve 740 that may be adjusted to control the fluid flow through the accumulation chamber 710. In one embodiment, fluid, such as steam, flows in a path from the inner diameter of the injection housing 728, through orifices 714, through the accumulation chamber 710, and out of the adjustable valve 740. Fluid passing out of the adjustable valve 740 passes into an open, second chamber 742 defined by the shroud 704 and the injection housing 728 (e.g., the upper tubular 702 or lower tubular 708). Fluid can pass through the second chamber 742, past the centralizing fins 712, and out into the annulus formed between the injection tool 712 and the surrounding wellbore. In alternate embodiments, the adjustable valve 740 may be placed elsewhere. In alternate embodiments, the fluid may flow in the opposite direction (e.g., from the wellbore into the inner diameter of the injection housing 728).

The adjustable valve 740 may be comprised of a valve seat 720 and a valve plug 718. In an embodiment, the valve seat 720 is positioned on a tubular of the injection housing 728, such as the upper tubular 702 or the lower tubular 708. The valve seat 720 may be formed of the tubular or may be welded or otherwise attached thereto. The valve plug 718 may be positioned on the shroud 704. The valve plug 718 may move laterally with respect to the valve seat 720 between a fully closed position and a fully open position. In a fully closed position, the valve plug 718 may abut the valve seat 720 and block all or substantially all fluid flow through (e.g., out of) the accumulation chamber 710. In various positions between the fully closed position and the fully open position, the valve plug 718 may be positioned to control the fluid flow through the accumulation chamber 710, thus controlling fluid flow out of the fluid injection tool 700.

The position of the valve plug 718 may be controlled by laterally translating the shroud 704. As described above, the shroud 704 may be laterally translated by rotating the shroud about the center nipple 706 due to threading 730 between the shroud 704 and the injection housing 728. The valve plug 320 may be translated in other suitable ways.

The injection housing 728 may additionally include fins 712 that centralize the shroud 704 about the injection housing 728. The fins 712 may help keep the shroud 704 secure and may maintain the valve seat 720 aligned with the valve plug 718. The fins 712 may be formed of tubulars of the injection housing 728 (e.g., the upper tubular 702 and/or the lower tubular 708) or may be welded or otherwise attached thereto. In some embodiments, the fins 712 and valve seat 720 are a combined piece that may be welded or otherwise attached to a tubular of the injection housing 728.

As seen in FIG. 7, a single fluid injection tool 700 may include multiple shrouds 704, multiple accumulation chambers 710, and multiple valve seats 720 and valve plugs 718, allowing for more control of fluid injection. Shrouds 704 may be located about each of the upper tubular 702 and lower tubular 708, or corresponding upper and lower locations when the injection housing 728 includes a single, continuous tubular instead of separate upper tubulars 702 and lower tubulars 708. In alternate embodiments, a fluid injection tool 700 may have a single shroud 704 located about only one of the upper tubular 702 or lower tubular 708, or corresponding location, as described above.

At a rig site, to configure the fluid injection tool 700 for a desired output, a user may remove or loosen the securing element 732, rotate the shroud 704 the desired number of times, and then replace or tighten the securing element 732. This process may be repeated for each shroud 704 on a fluid injection tool 700.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a fluid injection tool including an injection housing, a shroud, and an adjustable valve. The shroud is positioned about the injection housing and defines an accumulation chamber between the shroud and the injection housing, wherein the injection housing includes an orifice fluidly connecting an inner diameter of the injection housing to the accumulation chamber. The adjustable valve is fluidly coupled to the accumulation chamber for controlling fluid flow through the accumulation chamber.

Example 2 is the tool of example 1 where the accumulation chamber is fluidly positioned between the adjustable valve and the injection housing.

Example 3 is the tool of examples 1 and 2 where the adjustable valve includes a valve seat and a valve plug. The valve plug is movably positionable with respect to the valve seat. The valve seat is coupled to the shroud and the valve plug is coupled to a plug.

Example 4 is the tool of example 3 where the plug is positioned about the injection housing and linearly translatable with respect to the injection housing.

Example 5 is the tool of example 4 where the plug is threadedly engaged with the injection housing whereby the plug linearly translates along the injection housing upon rotation of the plug about the injection housing.

Example 6 is the tool of examples 3-5 where the injection housing comprises an upper tubular coupled to a lower tubular by a center nipple; the shroud is coupled to the center nipple; and the plug is positioned about one of the upper tubular and the lower tubular.

Example 7 is the tool of examples 1-6 also including a door positionable in the injection housing to block fluid flow through the orifice.

Example 8 is the tool of examples 1-7 also including an additional shroud positioned about the injection housing and defining an additional accumulation chamber between the additional shroud and the injection housing. The injection housing includes an additional orifice fluidly connecting the inner diameter of the injection housing to the additional accumulation chamber. The tool also includes an additional adjustable valve fluidly coupled to the additional accumulation chamber for controlling fluid flow through the additional accumulation chamber.

Example 9 is a method including supplying fluid to an injection housing; directing fluid, through an orifice of the injection housing, to an accumulation chamber formed between the injection housing and a shroud positioned about the injection housing; and throttling fluid flow through the accumulation chamber by an adjustable valve.

Example 10 is the method of example 9 also including setting the adjustable valve to a desired setting.

Example 11 is the method of example 10 where the adjustable valve comprises a valve plug movably positionable with respect to a valve seat; and setting the adjustable valve comprises linearly translating the valve plug in relation to the valve seat.

Example 12 is the method of example 11 where linearly translating the valve plug comprises rotating the valve plug about the injection housing and securing the valve plug at a desired position.

Example 13 is the method of examples 9-13 also including positioning a door within the injection housing to block fluid flow through the orifice.

Example 14 is a fluid injection tool including an injection housing having an inner diameter; a shroud coupled to the injection housing; a plug sleeve positioned between the injection housing and the shroud; an adjustable valve comprising a valve seat and a valve plug, wherein the valve seat is coupled to the shroud, and wherein the valve plug is coupled to the plug sleeve; and an accumulation chamber defined by the shroud, the injection housing, and the adjustable valve, wherein the accumulation chamber is fluidly coupled to the inner diameter of the injection housing through an orifice in the injection housing, and wherein the adjustable valve controls fluid flow through the accumulation chamber.

Example 15 is the tool of example 14 where the injection housing comprises a first tubular coupled to a second tubular by a center nipple, and wherein the shroud is coupled to the center nipple.

Example 16 is the tool of examples 14 and 15 where the valve plug is movable with respect to the valve seat to adjust the adjustable valve.

Example 17 is the tool of example 16 where the plug sleeve is rotatable about the injection housing to the adjust the adjustable valve.

Example 18 is the tool of examples 14-17 also including a door positionable in the injection housing to block fluid flow through the orifice.

Example 19 is the tool of examples 14-18 also including an additional shroud coupled to the injection housing; an additional adjustable valve defined between an additional valve seat of the additional shroud and an additional valve plug of an additional plug sleeve, the additional valve plug movably positioned with respect to the additional valve seat; and an additional accumulation chamber defined by the additional shroud, the injection housing, and the additional adjustable valve, wherein the additional accumulation chamber is fluidly coupled to the inner diameter of the injection housing through an additional orifice in the injection housing, and wherein the additional adjustable valve controls fluid flow through the additional accumulation chamber.

Example 20 is the tool of example 19 where the additional plug sleeve is rotatable about the injection housing to adjust the additional adjustable valve.

What is claimed is:

1. A fluid injection tool comprising:

an injection housing comprising a first set of threads;

a shroud positioned about the injection housing and defining an accumulation chamber between the shroud and the injection housing, wherein the injection housing includes an orifice fluidly connecting an inner diameter of the injection housing to the accumulation chamber; and an adjustable valve fluidly coupled to the accumulation chamber for controlling fluid flow through the accumulation chamber, the adjustable valve comprising:

a plug sleeve comprising a second set of threads threadedly engaged with the first set of threads of the injection housing, wherein the plug sleeve is rotatable about a central longitudinal axis of the injection housing to linearly translate a valve plug coupled to the plug sleeve toward or away from a valve seat coupled to the shroud to throttle the fluid flow.

2. The tool of claim 1, wherein the accumulation chamber is fluidly positioned between the adjustable valve and the injection housing.

3. The tool of claim 1, wherein:

the plug sleeve is positioned about the injection housing.

4. The tool of claim 1, wherein:

the injection housing comprises an upper tubular coupled to a lower tubular by a center nipple;

the shroud is coupled to the center nipple; and the plug sleeve is positioned about one of the upper tubular and the lower tubular.

5. The tool of claim 1, further comprising a door positionable in the injection housing to block fluid flow through the orifice.

6. The tool of claim 1, further comprising:

an additional shroud positioned about the injection housing and defining an additional accumulation chamber between the additional shroud and the injection housing, wherein the injection housing includes an additional orifice fluidly connecting the inner diameter of the injection housing to the additional accumulation chamber; and an additional adjustable valve fluidly coupled to the additional accumulation chamber for controlling fluid flow through the additional accumulation chamber.

7. A method, comprising:

supplying fluid to an injection housing comprising a first set of threads;

directing fluid, through an orifice of the injection housing, to an accumulation chamber formed between the injection housing and a shroud positioned about the injection housing; and throttling fluid flow through the accumulation chamber by an adjustable valve comprising a plug sleeve, the plug sleeve comprising a second set of threads threadedly engaged with the first set of threads of the injection housing, wherein the plug sleeve is rotatable about a central longitudinal axis of the injection housing to linearly translate a valve plug coupled to the plug sleeve toward or away from a valve seat coupled to the shroud to throttle the fluid flow.

8. The method of claim 7, further comprising:

setting the adjustable valve to a desired setting.

9. The method of claim 7, wherein linearly translating the valve plug comprises rotating the valve plug about the injection housing to move the valve plug to a desired position.

10. The method of claim 7, further comprising:

positioning a door within the injection housing to block fluid flow through the orifice.

11. A fluid injection tool, comprising:

an injection housing having an inner diameter and a first set of threads;

a shroud coupled to the injection housing; a plug sleeve positioned between the injection housing and the shroud, wherein the plug sleeve comprises a second set of threads threadedly engaged with the first set of threads;

an adjustable valve comprising a valve seat and a valve plug, wherein the valve seat is coupled to the shroud, and wherein the valve plug is coupled to the plug sleeve; and an accumulation chamber defined by the shroud, the injection housing, and the adjustable valve, wherein the accumulation chamber is fluidly coupled to the inner diameter of the injection housing through an orifice in the injection housing, and wherein the plug sleeve is rotatable about a central longitudinal axis of the injection housing to linearly translate the valve plug toward or away from the valve seat to throttle fluid flow through the accumulation chamber.

12. The tool of claim 11, wherein the injection housing comprises a first tubular coupled to a second tubular by a center nipple, and wherein the shroud is coupled to the center nipple.

13. The tool of claim 11, wherein the valve plug is movable with respect to the valve seat to control the adjustable valve.

14. The tool of claim 13, wherein the plug sleeve is rotatable about the injection housing to control the adjustable valve.

15. The tool of claim 11, further comprising a door positionable in the injection housing to block fluid flow through the orifice.

16. The tool of claim 11, further comprising:

an additional shroud coupled to the injection housing;

an additional adjustable valve defined between an additional valve seat of the additional shroud and an additional valve plug of an additional plug sleeve, the additional valve plug movably positioned with respect to the additional valve seat; and an additional accumulation chamber defined by the additional shroud, the injection housing, and the additional adjustable valve, wherein the additional accumulation chamber is fluidly coupled to the inner diameter of the injection housing through an additional orifice in the injection housing, and wherein the additional adjustable valve controls fluid flow through the additional accumulation chamber.

17. The tool of claim 16, wherein the additional plug sleeve is rotatable about the injection housing to adjust the additional adjustable valve.

* * * * *